United States Patent [19]

Bille

[11] 4,173,436

[45] Nov. 6, 1979

[54] PIVOTABLE PIPE SLIDE FOR USE IN A TWO CYLINDER CONCRETE PUMP

[75] Inventor: Heinz Bille, Unna, Fed. Rep. of Germany

[73] Assignee: Maschinenfabrik Walter Scheele KG, Unna-Massen, Fed. Rep. of Germany

[21] Appl. No.: 911,727

[22] Filed: Jun. 1, 1978

[30] Foreign Application Priority Data

Jun. 3, 1977 [DE] Fed. Rep. of Germany ..... 2725089

[51] Int. Cl.[2] ..... F04B 15/02

[52] U.S. Cl. ..... 417/516; 417/532; 417/900; 285/185

[58] Field of Search ..... 417/516, 517, 519, 532, 417/900; 285/184, 185

[56] References Cited

U.S. PATENT DOCUMENTS

| | | | |
|---|---|---|---|
| 15,134 | 6/1856 | King | 417/532 |
| 3,829,254 | 8/1974 | Stetter et al. | 417/517 |
| 3,832,097 | 8/1974 | Schlect | 417/516 |
| 3,929,400 | 12/1975 | Merton | 417/516 |

*Primary Examiner*—Carlton R. Croyle
*Assistant Examiner*—R. E. Gluck
*Attorney, Agent, or Firm*—Allison C. Collard; Thomas M. Galgano

[57] ABSTRACT

A pivotable pipe slide for use in a two cylinder concrete pump includes a swing pipe which is pivotably moved in a reciprocal fashion between the two discharge openings of the pump cylinders in such a manner that it is pressed against the discharge openings in its end positions, while it is moved away therefrom during its pivotal movement between its end positions. Pivoting is effected by means of a movable joint which is coupled to an end segment of the swing pipe and which has an axis disposed normally to the pivot plane of the swing pipe, a fixed joint spaced from the movable joint and disposed centrally between the discharge openings which also has an axis disposed normally to the pviot plane and a guide joint which is coupled to the movable joint and is pivotable about the fixed joint.

6 Claims, 4 Drawing Figures

PIVOTABLE PIPE SLIDE FOR USE IN A TWO CYLINDER CONCRETE PUMP

The present invention relates to a pivotable pipe slide for use in a two-cylinder concrete pump having a swing pipe which moves reciprocally between two discharge openings of the pump cylinders. More particularly, it relates to such a pipe slide having a swing pipe, one end of which is coupled to a feed line, and the other pivotable end of which is pressed against the sealing faces of the discharge openings in its end pivot positions, and which is moved away from the sealing faces during the pivot movement.

In accordance with the known pivotable pipe slides which are used in two cylinder concrete pumps, the danger exists that the sealing faces in the area of the discharge openings and the swing pipe in the area of its pivotable end which engages the sealing faces wear very rapidly. This danger is particularly great when the end of the swing pipe remains pressed against the sealing faces during the pivot movement. In order to avoid this problem, it is known from the prior art (U.S. Pat. No. 3,832,097) to remove the pressure force during pivoting, or to remove the endangered end of the swing pipe from the sealing faces and only to press the same against the sealing faces in the end positions thereof.

This is achieved in the known state of the art in that hydraulic adjustment elements are provided for the swing pipe which are correspondingly controlled. However, due to this additional hydraulic means, the swing pipe is too expensive and subject to additional breakdown.

It is, therefore, an object of the subject invention to provide a swing pipe slide wherein the removal of the end of the swing pipe from the sealing faces during the pivot process and the pressing of the end of the swing pipe against the sealing faces in the end position thereof is achieved by simple mechanical means.

This object is achieved according to the subject invention by the provision of a swing pipe slide of the aforementioned type, wherein one end of the swing pipe is pivotable in a plane perpendicular with respect to the sealing faces of the discharge openings and is coupled to a joint having a joint axis which runs normally with respect to the pivot plane. The joint is coupled to a guide joint which is pivotable about a further fixed joint which is positioned centrally between the discharge openings of the pump cylinders, the joint axis of which also runs normally with respect to the pivot axis of the swing pipe.

Due to the use of the inventive guide joint, a circular-like movement path of the wear-subjected end of the swing pipe is obtained in cooperation with the pivot movement of the swing pipe. Thereby, the circular path is arched in such a way that the wear-subjected end of the swing pipe is removed from the sealing faces during the pivot movement and is pressed against these sealing faces in the end position by the force created by the pivot movement, i.e., by a perpendicular directed force component of this force. No additional hydraulic pressure means are required. The guide joint itself is a rather simple mechanical element and is, accordingly, robust and wear-resistent.

In accordance with a preferred embodiment of the invention, the fixed joint as seen from the position of the swing pipe is located behind the sealing faces of the discharge openings and the sealing faces lie in planes which are at an inclined obtuse angle relative to each other in a generally V-shaped position. In this manner, the circular-like movement path of the end of the swing pipe is shortened and thereby the required time period for switching over to the next position is also shortened. On the other hand, the force component which is directed to the given sealing face is increased due to this arrangement.

The guide joint may also be advantageously used for driving the swing pipe. For this purpose, the guide joint is reciprocally driven around a fixed joint.

In a particularly preferred embodiment of the invention, the guide joint is pivoted about the fixed joint by a lever arm which is engaged at its free end with a pressure medium cylinder for moving the joint guide in a reciprocal fashion. This type of drive for the guide joint is also very simple in its structure and in its operation.

In order to provide a guide path for the swing pipe at its end remote from the sealing faces and so as not to hinder the movement path of the opposite end of the swing pipe in the area of the sealing faces, the swing pipe is guided in a straight guide path by means of a pin which is positioned normally with respect to the pivot plane of the swing pipe, whereby the straight guide path is positioned opposite the sealing faces. This pin in cooperation with the guide path permits a pivoting of the swing pipe while simultaneously equalizing the arch height of the circular path of the pipe end in the area of sealing faces. The transmission to the feed cylinders has a corresponding movability and may, for example, be a hose coupling.

In order to better distribute the forces and to keep the joints free from unfavorable moments, the guide joint consists of two guide joint elements which are coupled by a joint bolt of a fixed joint in a parallel and rigid position with respect to each other. The free ends of these joint elements are coupled to the swing pipe by a pair of joint pins which are mounted opposite each other on the outer wall of the swing pipe and which, together with the guide joint elements, form the joint associated with the swing pipe.

Other objects and features of the present invention will become apparent from the following detailed description when taken in connection with the accompanying drawings which discloses several embodiments of the invention. It is to be understood that the drawings are designed for the purposes of illustration only, and are not intended as a definition of the limits and scope of the invention disclosed.

In the drawings, wherein similar reference numerals denote similar elements throughout the several views.

Figure 1:
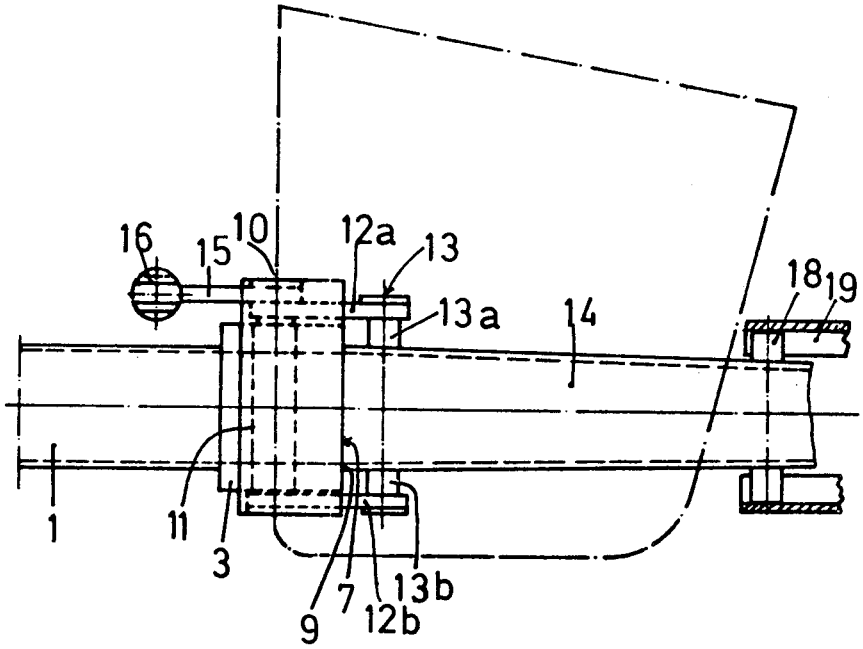
FIG. 1 is a side view of a pivotable pipe slide embodying the present invention, wherein the swing pipe is straight.

Referring now in detail to the drawings, two feed cylinders of the two-cylindrical concrete pumps are provided designated by reference numerals 1 and 2. Feeding cylinders 1 and 2 are coupled with each other at their ends by an intermediary member 3 having two bores 4 and 5 which lie at an acute angle with respect to each other and run into bores of feeding cylinders 1 and 2. At the side of feeding cylinders 1 and 2, bores 4 and 5 form the discharge openings 6 and 7 of the two feeding cylinders 1 and 2. Sealing faces 8 and 9 extend around discharge openings 6 and 7, and each lie in planes which form an obtuse angle with respect to each other.

At the center between the two cylinders 1 and 2, a fixed joint 10 is mounted on the intermediary member 3, and a joint bolt 11 extends vertically through intermediary member 3. Guide or control elements **12*a* and 12*b* are fixedly mounted on the upper and lower end of joint bolt 11 which together form a guide or control joint comprising elements 12*a* and 12*b***.

The free ends of guide elements **12*a* and 12*b* are coupled with a pivotable swing pipe 14 by means of joint pins 13*a* and 13*b*. Joint pins 13*a* and 13*b* are mounted on the outer wall of the swing pipe 14 and together form a joint 13 associated with the swing pipe which has a vertically-disposed axis with respect to the horizontal pivot plane of swing pipe 14**.

Guide joint **12*a*, 12*b* is extended beyond the joint axis of joint 10 by means of a lever 15, the free end of which engages a piston rod of pressure medium or fluid cylinder 16**.

Figure 2:
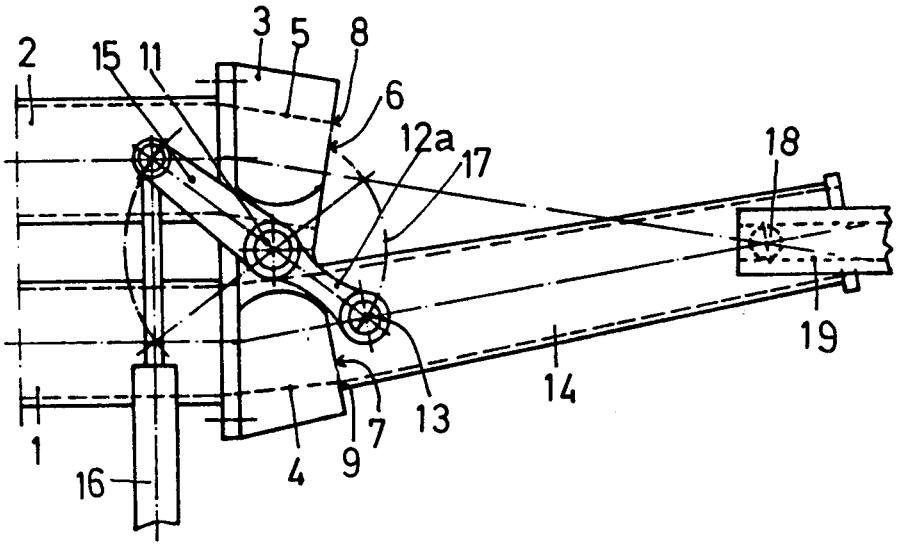
FIG. 2 is a plan view of the slide shown in FIG. 1.
Figure 4:
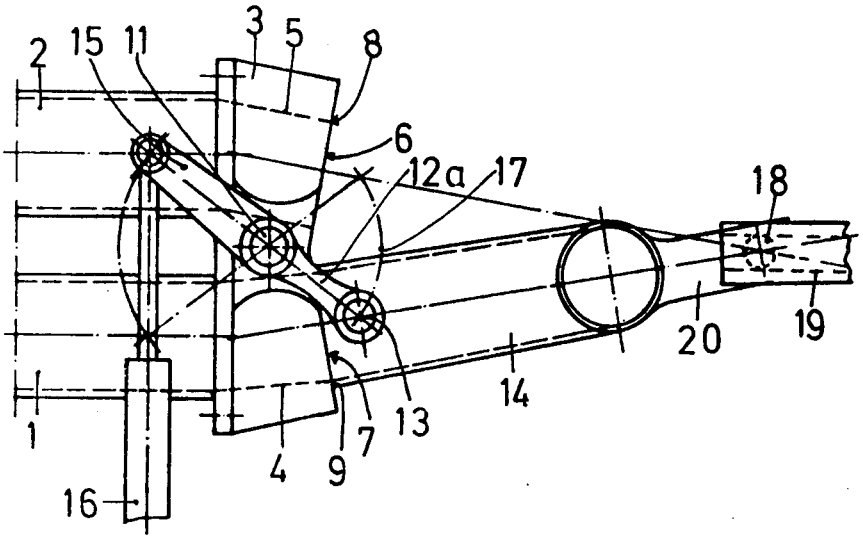
FIG. 4 is a plan view of the slide shown in FIG. 3.

By retracting and extending the piston rod of cylinder 16, guide joint **12*a*, 12*b* may be pivoted reciprocally by means of lever 15 around the fixed joint 10, whereby a circular-like movement path is transmitted to the end of swing pipe 14 around the axis of rigid joint 10. As can be seen in FIGS. 2 and 4, this circular path is shown as 17. This radial movement path provides that the end of the swing pipe 14 is moved away from the associated sealing faces 8 and 9 of intermediary member 3 during the pivot movement and is pressed against these sealing faces 8 and 9 in the end positions thereof. Since the joint axis 10, as seen from the position of swing pipe 14 is positioned behind sealing faces 8 and 9, and since the sealing faces 8 and 9 are positioned with respect to each other so as to form an obtuse angle, the radial movement path 17 of the end of swing pipe 14 is relatively short, so that the force components which act in the direction of the sealing faces 8, 9 are relatively large. At the side facing the sealing faces 8 and 9, swing pipe 14 is guided in a straight guide path 19 by means of a vertically-disposed common axis 18. This type of guidance permits a pivoting of swing pipe 14 in the horizontal direction as well as an equalization of the arch height of circular path 17**.

Naturally, the transmission to the feeding pipe is so arranged (not shown) that the pivot movement of swing pipe 14 is not being hindered. For this purpose, hose joints are particularly suitable.

Figure 3:
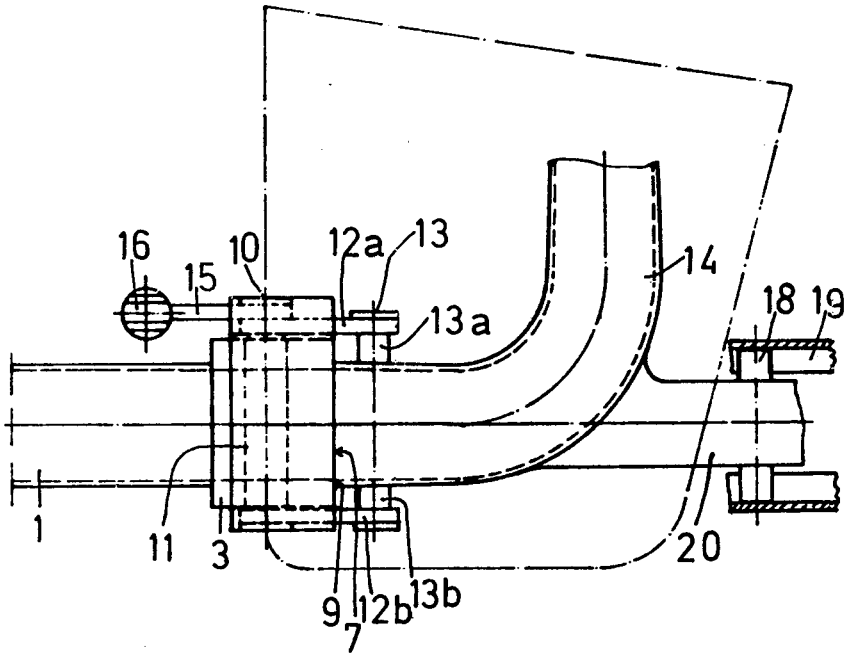
FIG. 3 is a side view of an alternate embodiment of the pivotable pipe slide wherein the swing pipe is curved.

In the embodiment in accordance with FIGS. 1 and 2, swing pipe 14 is straight, and the guide members 18 and 19 are mounted directly on the swing pipe. In the embodiment of FIGS. 3 and 4, swing pipe 14 is bent upwardly, and so the guide members 18 and 19 are mounted on an extension arm 20 of swing pipe 14.

While only several embodiments of the present invention have been shown and described, it will be obvious to those persons of ordinary skill in the art that many changes and modifications may be made thereunto without departing from the spirit and scope of the invention.

What is claimed is:

1. A pivotable slide for use in a two-cylinder concrete pump having two discharge openings, each of which is bordered by a sealing face, comprising:

a swing pipe having an end segment which is reciprocably pivotable in a pivot plane perpendicular to the planes of the sealing faces; and pivot means for reciprocally pivoting said end segment of said swing pipe between a first end position, in which said end segment is pressed against the sealing face of one of said discharge openings, and a second end position, in which said end segment is pressed against the sealing face of the other of said discharge openings, said pivot means moving said end segment away from contact with said sealing faces during the pivoted movement thereof between said first and second end positions, said pivot means including a movable joint having an axis which is disposed normally relative to the pivot plane of said end segment and which is coupled to said end segment, a fixed joint, spaced from said movable joint and disposed centrally between said discharge openings and having an axis which is parallel to said movable joint and a guide joint which is coupled to said movable joint and is pivotable about said fixed joint.

2. The pipe slide according to claim 1, wherein said fixed joint, as seen from the position of said swing pipe, is disposed behind said sealing faces of said discharge openings and wherein said sealing faces each lie in a plane which are at an obtuse angle with respect to one another so as to define a V-shaped position of said sealing faces.

3. The pipe slide according to claim 1, additionally including drive means for reciprocally-pivoting said guide joint about said fixed joint.

4. The pipe slide according to claim 3, wherein said drive means includes a lever arm, one end of which is pivotably mounted on said fixed joint and coupled to said guide joint and the other end of which is coupled to a piston rod of pressure medium cylinder for reciprocally pivoting said guide joint.

5. The pipe slide according to claim 1, wherein said swing pipe is guided in a straight guide path opposite said sealing faces by means of a guide pin having an axis disposed normally relative to said pivot plane.

6. The pipe slide according to claim 1, wherein said movable joint includes two joint pins which are mounted on the outer wall of said swing pipe opposite one another, said fixed joint includes a joint bolt, and said guide joint includes two guide joint elements disposed in a parallel and fixed position relative to one another, the inner ends of which are coupled to said joint bolt and the outer ends of which are each coupled to one of said joint pins.

* * * * *

UNITED STATES PATENT AND TRADEMARK OFFICE

CERTIFICATE OF CORRECTION

PATENT NO. : 4,173,436

DATED : NOVEMBER 6, 1979

INVENTOR(S) : HEINZ BILLE

It is certified that error appears in the above—identified patent and that said Letters Patent is hereby corrected as shown below:

Column 2, line 15, change "joint guide" to --guide joint--; Column 3, line 21, after 'rod of', insert --a--. Column 4, line 44, after 'rod of', insert --a--.

Signed and Sealed this

*Twenty-fifth* Day of *March 1980*

[SEAL]

*Attest:*

SIDNEY A. DIAMOND

*Attesting Officer*

*Commissioner of Patents and Trademarks*